United States Patent [19]

Morris et al.

[11] Patent Number: 4,926,974

[45] Date of Patent: May 22, 1990

[54] ELEVATOR CAR WITH IMPROVED CAR DOOR CLUTCH

[75] Inventors: Arnold M. Morris, Chester Twp., Morris County; Daphne D'Zurko, Pompton Lakes; Richard H. Pilsbury, Demarest, all of N.J.; J. Warren Barkell, Jr., Penn Twp., Westmoreland County, Pa.; Karl B. Orndorff, Bonneauville Boro, Adams County; Lawson Randall S., Gettysburg, both of Pa.

[73] Assignee: Inventio AG, Hergiswil, Switzerland

[21] Appl. No.: 309,629

[22] Filed: Feb. 13, 1989

[51] Int. Cl.[5] ..... B66B 13/00

[52] U.S. Cl. ..... 187/52 LC; 187/61; 49/120

[58] Field of Search ..... 187/52 LC, 52 R, 57, 187/61, 51; 49/116, 120, 122

[56] References Cited

U.S. PATENT DOCUMENTS

| | | | |
|---|---|---|---|
| 1,326,440 | 12/1919 | Chaudoir | 187/61 |
| 1,838,524 | 12/1931 | Brown | 187/61 |
| 2,859,835 | 11/1958 | Borden | 187/52 LC |
| 3,065,826 | 11/1962 | Tucker, Jr. | 187/52 LC |
| 3,605,952 | 9/1971 | Lusti | 187/52 LC |
| 3,659,677 | 5/1972 | Shalders | 187/61 |
| 3,721,319 | 3/1973 | Hall et al. | 187/61 |
| 4,313,525 | 2/1982 | McDonald | 187/57 |
| 4,357,998 | 11/1982 | Gibson et al. | 187/49 |
| 4,364,454 | 12/1982 | Glaser et al. | 187/57 |
| 4,423,799 | 1/1984 | Glaser et al. | 187/57 |
| 4,436,184 | 3/1984 | Dorman et al. | 187/29 R |
| 4,469,200 | 9/1984 | Young et al. | 187/61 |
| 4,491,200 | 1/1985 | Thompson et al. | 187/61 |
| 4,512,443 | 4/1985 | Dewhurst | 187/57 |
| 4,529,065 | 7/1985 | Kraft | 187/57 |

FOREIGN PATENT DOCUMENTS

| | | | |
|---|---|---|---|
| 0164581 | 12/1985 | European Pat. Off. | 187/61 |
| 1002929 | 2/1957 | Fed. Rep. of Germany | 187/52 LC |
| 2164980 | 7/1972 | Fed. Rep. of Germany | 187/52 LC |
| 468376 | 1/1937 | United Kingdom | 187/61 |
| 1047977 | 11/1966 | United Kingdom | 187/57 |

*Primary Examiner*—H. Grant Skaggs
*Assistant Examiner*—Kenneth Noland
*Attorney, Agent, or Firm*—D. R. Lackey

[57] ABSTRACT

An elevator car having a clutch pivotally carried by a car door and biased to an operative position in which drive rollers of an adjacent hatch door may be engaged by "open" and "close" vanes. A first parallelogram linkage operates the close vane in direct response to car door position, in a direction opposite to initial car door opening movement. A second parallelogram linkage, associated with the open vane, is operated when the open vane contacts a hatch door roller at the start of door opening, to unlock the car door by retracting a plunger from an opening in the car door sill. The car door clutch bias may be manually overcome by authorized maintenance personnel, to disengage the car door from a hatch door.

13 Claims, 6 Drawing Sheets

ELEVATOR CAR WITH IMPROVED CAR DOOR CLUTCH

TECHNICAL FIELD

The invention relates to elevator cars, and more specifically to the construction of an elevator door clutch carried by an elevator car door which engages the drive rollers of an adjacent hatch door for simultaneous movement of a hatch door with a driven car door.

BACKGROUND ART

An elevator car door is driven between open and closed positions relative to an entrance to a cab by a door operator mounted on top of the cab. The cab, door operator and cab support or sling are collectively referred to as an elevator car. The hatch door at each floor of a building an elevator car is serving is unlocked by the car at the associated floor, and a clutch carried by the car door has "open" and "close" vanes which engage appropriate elements on the hatch door, such as hatch door rollers, to respectively open and close the hatch door in unison with the car door.

It is desirable, and an object of the present invention, to reduce noise associated with the operation of the car and hatch doors. It is also desirable and another object of the invention to permit the car and hatch doors to be de-coupled by authorized personnel for maintenance purposes, without damaging the clutch or hatch door rollers. It is also desirable and another object of the invention to mechanically lock the car door between floors, and to automatically unlock it when an attempt is made to open the car door and the car is within a predetermined dimension from a floor.

DISCLOSURE OF THE INVENTION

Briefly, the present invention is an elevator car including an improved car door clutch having features which reduce the noise associated with clutch operation, while permitting de-coupling of car and hatch doors by authorized personnel without damaging contact between the car door clutch and hatch door rollers. The clutch construction also functions to provide automatic door lock actuation and release.

More specifically, the car door clutch is pivotally carried by an elevator car door, with the clutch being biased to an operative position, in a direction towards a hatch door, by a bias which may be overcome by authorized personnel. Manually pivoting the car door clutch against the force of the bias allows the clutch to assume a temporary position in which the clutch vanes and hatch door rollers may clear one another without contact.

The car door clutch is automatically changed from a first configuration which provides running clearances of about 0.25 inch, measured between the open vane and an adjacent hatch door roller, and between the close vane and an adjacent hatch door roller, to a second configuration which gently places the close vane against one of the hatch door rollers while the open vane is engaging the other hatch door roller. Thus, there is little noise producing relative movement between the clutch and drive rollers, and component damaging shock between engaging elements of the car and hatch doors is significantly reduced. The automatic change in spacing between the open and close vanes is accomplished entirely with reference to car door position. The positions of drive arms associated with the door operator are not utilized. A cam and cam follower are arranged for relative movement when the car door moves, such as by fixing the cam to the cab and fixing the cam follower to the door. A change in elevation as the cam follower encounters and then follows the cam is used to initiate the change in vane spacing. The spacing between the vanes is reduced when the car door starts to open, with the close vane being moved towards the open vane. The movement associated with the positional change of the close vane is opposite to the direction of car door movement. The cam is shaped to cause the close vane to move smoothly and noiselessly towards the open vane at substantially the same speed as the car door is moving in the opposite direction. Thus, there is zero relative velocity between the close vane and the hatch door rollers. Then, when the car and hatch doors are closed, as the car door reaches the fully closed position, the cam follower engages and rides up the cam to increase the spacing between the open and close vanes, to provide the requisite running clearance between each of the vanes and adjacent hatch door rollers as the car runs through a hatchway.

In a preferred embodiment of the invention, the close vane is mounted on a parallelogram linkage assembly, swinging in one direction to the running clearance position by being lifted and held in the running clearance position by the cam-cam follower action, and swinging in the opposite direction to the hatch door engaging position, by gravity, as the cam follower runs down the cam.

The door clutch includes a base which is fixed to the car door, a frame which is pivotally fixed to the base, to which the close vane is attached, and the open vane is pivotally fixed to the base on the same pivot axis as the frame which supports the close vane. Bias means in the form of springs bias the close and open vanes outwardly away from the major flat plane of the car door, towards the hatch wall and hatch doors. This is the normal operative position of the door clutch. When maintenance personnel desire to de-couple the car and hatch doors for maintenance purposes, manually depressing the clutch vanes, against the bias of the springs, enables the hatch door rollers and clutch vanes to pass one another during relative horizontal movement, thus quickly and easily accomplishing the de-coupling function without danger of damaging the hatch door rollers or door clutch vanes.

The open vane is constructed to include fixed and moveable plates linked by a parallelogram linkage assembly, resulting in a small movement of the movable plate as a hatch door roller is engaged to start the door opening process. This small movement is translated to a lifting motion which lifts a door locking plunger from an opening in the car door sill, to unlock the car door. If a passenger should attempt to open the car door when the car door clutch is not adjacent to a hatch door roller, the locking pin will remain in the car door sill, preventing the door from being opened beyond a small dimension defined by the length of the opening or slot formed in the door sill.

BRIEF DESCRIPTION OF THE DRAWINGS

The invention will become more apparent by reading the following detailed description in conjunction with the drawings, which are shown by way of example only, wherein.

DESCRIPTION OF PREFERRED EMBODIMENTS

Figure 1:
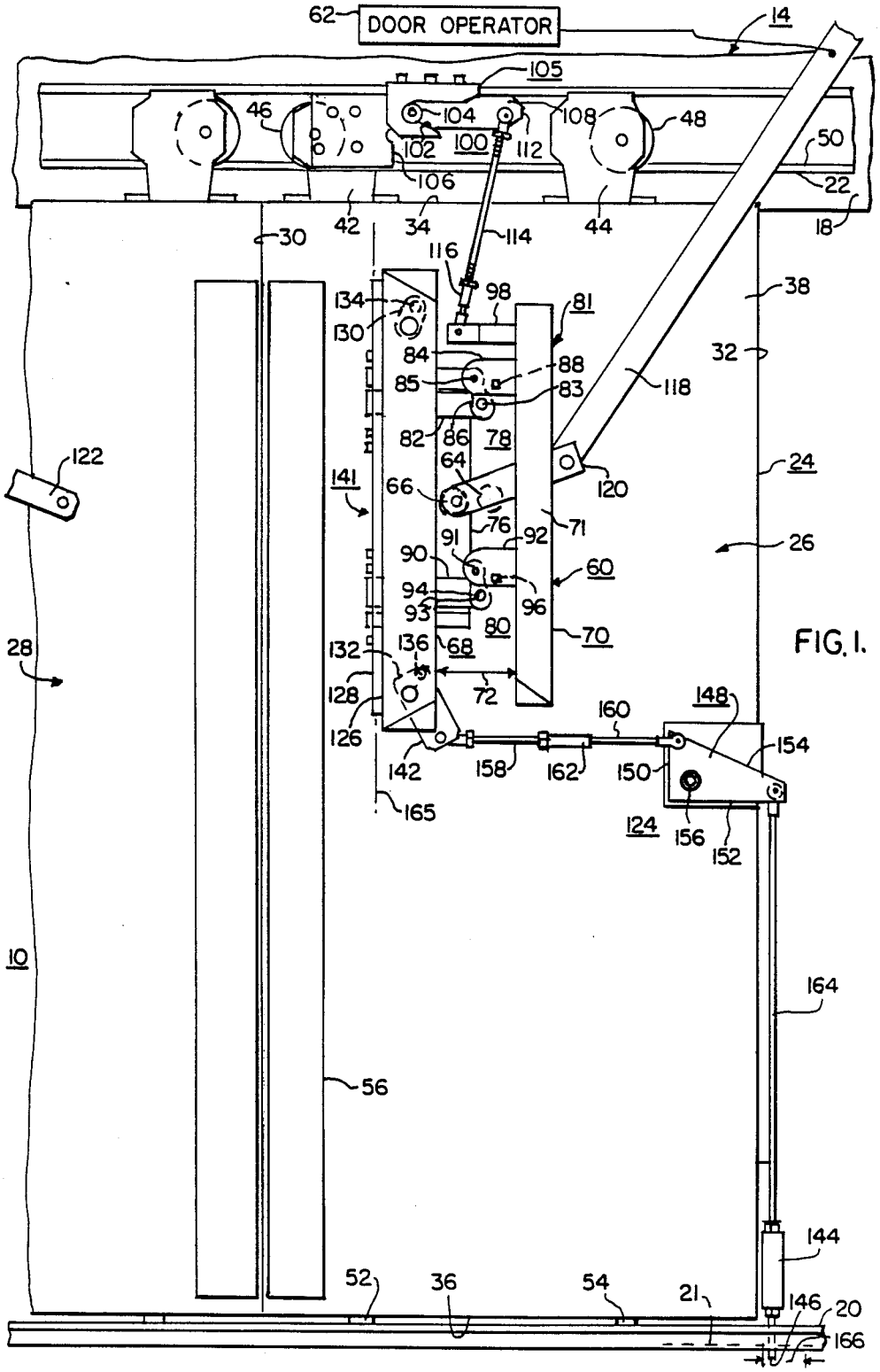
FIG. 1 is an elevational view of an elevator car illustrating a car door clutch constructed according to the teachings of the invention, with open and close vanes of the clutch in a running clearance position, and with a car door lock in a car door locking configuration.
Figure 2:
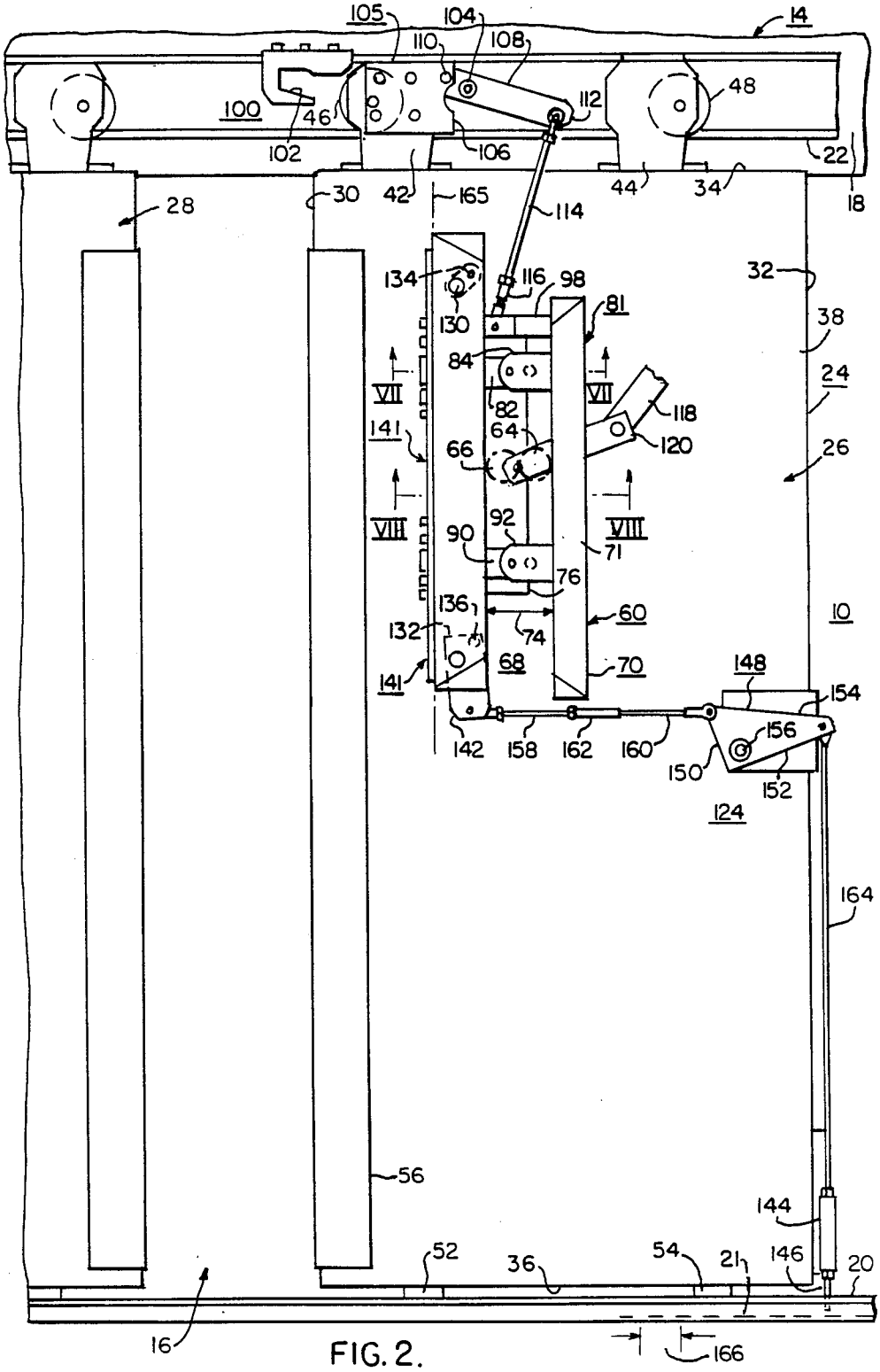
FIG. 2 is a view similar to that of FIG. 1, except with the open and close vanes in hatch door roller engaging positions, and with the car door lock released.
Figure 4:
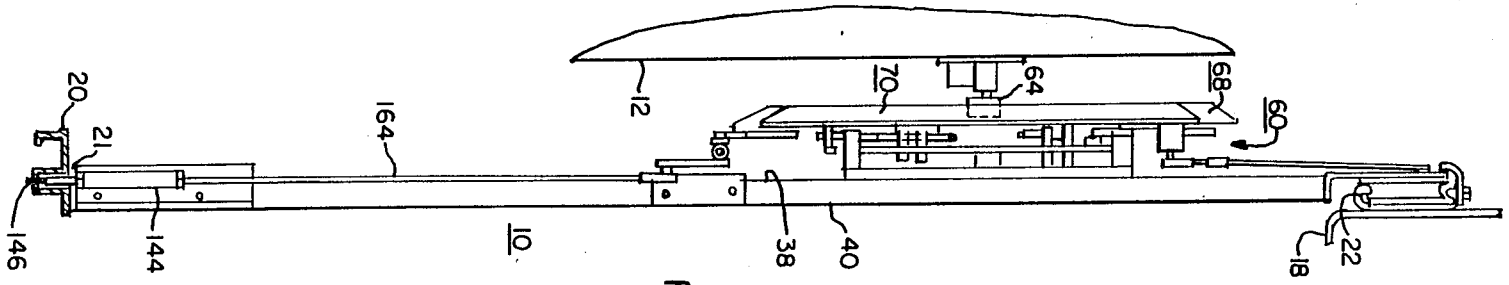
FIG. 4 is a right hand elevational view of the car door clutch and locking arrangement shown in FIG. 1, including a hatch door and hatch door rollers which are engaged by the car door clutch.

Referring now to the drawings, and to FIGS. 1, 2 and 4 in particular, there is shown in FIGS. 1 and 2 a front elevational view of an elevator car 10 as it would appear from the hatchway door side. A hatchway door is not shown in FIGS. 1 and 2, but a hatchway door 12 is shown in a fragmentary right hand elevational view of car 10 in FIG. 4.

Elevator car 10 includes a cab 14 which may be of conventional construction, having an opening 16 best shown in FIG. 2. Cab 14 includes a header 18 disposed above opening 16, a door sill 20 disposed below opening 16, and a hanger roller track 22 fixed to header 18 above opening 16. Car 10 includes a car door 24 having one or more door panels, with a center opening door 24 having first and second panels 26 and 28 being shown for purposes of example. Door panel 26 includes vertically oriented leading and trailing edges 30 and 32, respectively, horizontally oriented upper and lower edges 34 and 36, respectively, and outer and inner flat major surfaces 38 and 40, respectively, disposed in vertically oriented planes. Hangers 42 and 44, or functional equivalents, are fixed to the upper edge 34 of door panel 26, with hangers 42 and 44 including hanger rollers 46 and 48, respectively, which are supported by a lip 50 of hanger roller track 22. Gibs, such as gibs 52 and 54, are attached to the lower edge 36 of door panel 26, which extend into a continuous longitudinally extending groove 21 in door sill 20. A retractable object detecting edge 56 may be suitably attached to the leading edge 30 of door panel 26. Door panel 28 is similar to door panel 26 up to this point, and will not be described in detail.

Figure 3:
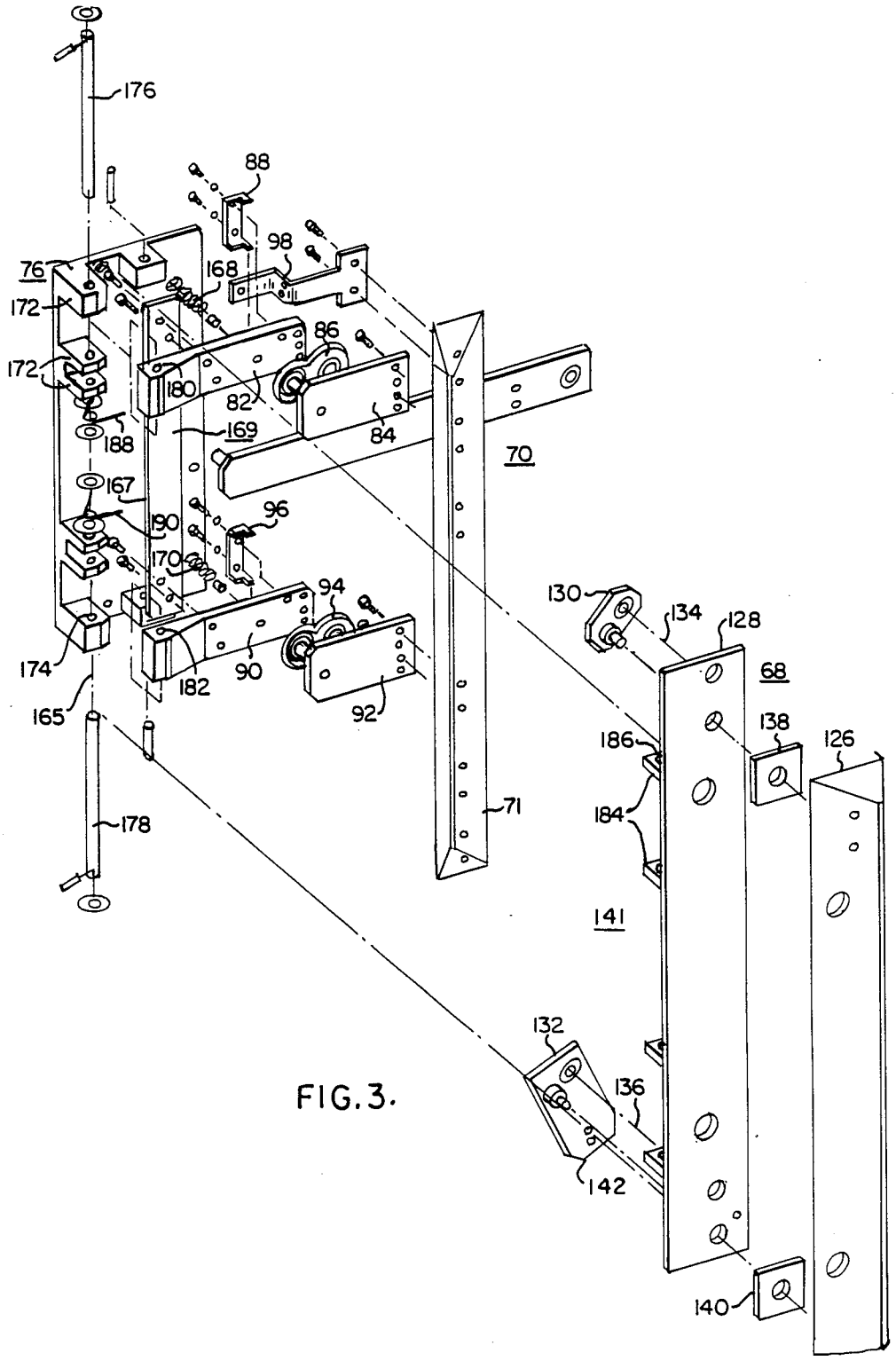
FIG. 3 is an exploded perspective view of the car door clutch shown in FIGS. 1 and 2.

A car door clutch constructed according to the teachings of the invention is fixed to one of the door panels 26 or 28. For purposes of example, a left-hand clutch 60 is shown fixed to door panel 26, but a right-hand clutch could be alternatively attached to door panel 28, as desired. A right-hand clutch is a mirror image of left-hand clutch 60, and thus need not be described in detail. FIG. 3 is an exploded perspective view of door clutch 60, and FIG. 3, along with FIGS. 1 and 2, will be referred to in the following description of door clutch 60.

The primary function of door clutch 60 is to engage elements of hatch door 12 such that when a door operator 62 is linked to car door 24 it will drive panels 24 and 26 with a horizontal rectilinear motion to open and close car door 24. An adjacent hatch door 12 is automatically unlocked by a conventional hatch door interlock, and then driven simultaneously, in unison with car door 24. Each hatch door 12 includes elements which are engaged by clutch 60, and for purposes of example they will be called drive block rollers, or simply hatch door rollers. First and second hatch door rollers 64 and 66 are shown in phantom in FIG. 1, and hatch door roller 64 is shown in FIG. 4.

Door clutch 60 includes first and second vane assemblies 68 and 70, with the first vane assembly 68 being referred to as the "open" vane because it engages hatch door drive roller 66 to unlock and open hatch door 12 when the car door 24 is being opened. The second vane assembly 70 is referred to as the "close" vane because it engages hatch door drive roller 64 to close hatch door 12 when the car door 24 is being closed. Upon opening, force of the open vane assembly 68 on roller 66 causes roller 66 to pivot towards roller 64, until roller 66 contacts roller 64. This movement of roller 66 is translated via a mechanical linkage which unlocks a conventional hatch door lock. Thus, the hatch door lock will not be described in detail.

When elevator car 10 is running through a hatchway of a building, a running clearance between each of the vanes 68 and 70 and each of the hatch door drive rollers 66 and 64 is required, such as about 0.25 inch, to insure a vane does not accidentally contact a drive roller. This results in a spacing between the open and close vanes of the car door clutch 60, indicated by double-headed arrow 72 in FIG. 1, which may be about 3.8 inches, for example. In order to reduce clutch noise, as well as mechanical shock which may damage vanes and/or rollers over time, the spacing between the open and close vanes indicated by arrow 72 is reduced to a spacing indicated by double headed arrow 74 in FIG. 2 when the elevator car 10 stops at a floor and starts the door opening process. If the spacing 72 between the open and close vanes while the car is running is about 3.8 inches, as used in the example, the operative spacing 74 between the open and close vanes when the car is stationary, with rollers 64 and 66 in contact with one another, and with vanes 68 and 70 snugly engaging rollers 66 and 64, may be about 3 inches.

The present invention accomplishes the change in spacing between the open and close vanes 68 and 70 without relating it to door operator function. Thus, any door operator may be used without any modification or adjustment required for actuation of the door clutch 60. The only adjustment required will be lock depth and the spacing 72 between the open and close vanes. The spacing change is related entirely and directly to car door position.

More specifically, door clutch 60 includes a support base 76, and the close vane assembly 70, which includes a close vane 71, derives its support from base 76 via upper and lower linkage arrangements 78 and 80, respectively, which define a parallelogram linkage assembly 81. The upper linkage arrangement 78 includes a support arm 82 mechanically related to base 76, a vane support arm 84 fixed to close vane 71, a pivot arm 86 pivotally interconnecting support arms 82 and 84 via pivot axes 83 and 85, respectively, and a stop bracket 88 which provides an over-travel limit for the close vane 71. Bracket 88 insures that the close vane 71 cannot rotate such that axis 85 of pivot arm 86 reaches a vertical line through axis 83. In like manner, the lower linkage arrangement 80 includes a support arm 90 mechanically related to base 76, a vane support arm 92 fixed to close vane 71, a pivot arm 94 pivotally interconnecting support arms 90 and 92 via pivot axes 91 and 93, respectively, and an over-travel stop bracket 96.

An operating or connecting bracket 98 is fixed to the upper end of close vane 71. The process of lifting operating bracket 98 pivots or swings close vane 71 upwardly and to the right, as illustrated in FIG. 1. The process of lowering operating bracket 98 allows the close vane 71 to swing downwardly to the left, by gravity, to the position shown in FIG. 2. To ensure that a force moment is not created which tends to swing the close vane 71 clockwise while it is driving hatch door roller 64, close vane 71 is allowed to swing downwardly until the pivot axis 85 through support arm 84 is slightly below a horizontal plane disposed through the pivot axis 83 associated with support arm 82, and the pivot axis 91 through support arm 92 is below a horizontal plane disposed through the pivot axis 93 associated with support arm 90. Thus, any force moment created during the closing process will attempt to maintain vane 71 in the closed or drive position.

The mechanical lifting and lowering process which results in the swinging of the close vane assembly 70 between the clearance and operative positions is directly responsive to the position of the elevator car door. Relative movement between car door 24 and cab 14 is translated to operation of door clutch 60 via a cam and cam follower arrangement 100 which includes a cam 102 and a cam follower 104. For purposes of example, cam 102 is fixed to the cab 14, i.e., to hanger roller track 22, and cam follower assembly 104 is fixed to door panel 26, i.e., to hanger 42, but their positions may be reversed, as desired.

More specifically, cam follower 104 is part of a clutch operator assembly 105 which includes a support plate 106 fixed to door hanger 42, an operator arm 108 having a first end pivotally fixed to support plate 106, as indicated by pivot pin 110, and a second end 112. Cam follower 104 is fixed to operator arm 108, between pivot pin 110 and the second end 112. The second end 112 of operator arm 108 is linked to bracket 98, such as via a threaded rod 114 having a turn buckle 116 adjusted to provide the desired vane spacing 74 shown in FIG. 2.

Cam 102 defines an inclined surface which is contacted by follower 104. As shown in FIGS. 1 and 2, door 24 is moved in its guided path by door operator 62. Door panel 26 is driven by a door operator arm 118 which is linked to the support base 76 of door clutch 60 via a link 120 which is pivotally fixed to both the clutch base 76 and the door operator arm 118. Door panel 28 is driven by a door operator arm similar to arm 118, which arm is linked to door panel 28 via a link 122 similar to link 120.

In the operational description of close vane assembly 70, it will first be assumed that door 24 is closing, with door panel 26 moving to the left as viewed in FIG. 2. As door panel 26 approaches the fully closed position shown in FIG. 1, cam follower 104 engages and rides up cam 102, lifting rod 114 and swinging the close vane assembly 70 such that the close vane 71 moves in a direction opposite to the closing door panel. This establishes a running clearance spacing between the close vane 71 and roller 64 as cam follower 104 reaches a stop provided at the end of the ramped portion of cam 102.

When car 10 stops at a floor and door operator 62 opens door 24, as panel 26 starts to move to the right, follower 104 will roll down cam 102. This action causes the close vane assembly 70 to move in a direction opposite to the moving door panel 26. Thus, vane 71 appears to have no horizontal motion relative to the stationary cab and hatch door until the close vane 71 is brought into contact with hatch door roller 64. Thus, the vanes of the door clutch 60 will quickly be in a position to move door panel 26 in either direction without noise and without damaging shock forces.

A car door lock 124 is provided for car door 24 which is operated by door clutch 60. Door clutch actuation is provided for door lock 124 by constructing the open vane assembly 68 to provide a predetermined mechanical movement which unlocks car door 24 when the open vane assembly 68 provides an opening force against hatch door roller 66. If door 24 is moved by a passenger when the open vane assembly 68 is not adjacent to hatch roller 66 then the mechanical door unlocking movement is not provided, maintaining car door 24 locked.

More specifically, as best shown in the exploded perspective view of FIG. 3, open vane assembly 68 includes an open vane 126, an open vane support plate 128, upper and lower pivot arms 130 an 132, respectively, which pivotally link open vane 126 with its support plate 128, and sliders 138 and 140. Thus, a parallelogram linkage arrangement 141 is provided for the open vane assembly 68 in which a force applied to the open vane 126 by hatch door roller 66 causes vane 126 to swing to the left when viewed in FIGS. 1 and 2, about pivot axes 134 and 136. The lower pivot arm 132 includes an integral downward extension which extends outside the superposed open vane 126 and its support plate 128, to provide an actuator tab 142 for the door lock assembly 124.

Thus, as the car door 24 starts to open, the open vane assembly 68 will contact roller 66, pivoting roller 66 towards roller 64 to provide a mechanical movement which is translated by a conventional linkage to unlock the hatch door. Co-pending application Ser. No. 231,407, filed Aug. 12, 1988, which is assigned to the same assignee as the present application, now U.S. Pat. No. 4,840,254, discloses a hatch door interlock. When roller 66 pivots to a point where it contacts roller 64, parallelogram linkage 141 rotates to the left, as viewed in the Figures, operating car door lock actuator tab 142. At the same time that linkage 141 is rotating to the left, parallelogram linkage 81 is also rotating to the left, resulting in both rollers 66 and 64, in addition to being in contact with one another, being in contact with the open and close vane assemblies 68 and 70, respectively.

Car door lock assembly 124 includes a spring loaded locking pin assembly 144 fixed to the trailing edge 32 of car door panel 26, with the locking pin assembly 144 including a locking plunger or pin 146 which is biased downwardly by a spring (not shown). A movement multiplying lever or bell crank 148 is pivotally fixed to outer major surface 38 of car door panel 26, with lever 148 having a configuration similar to a right triangle having first and second sides 150 and 152 of unequal dimension and a hypotenuse 154. Side 150 has a shorter dimension than side 152. A pivot bearing 156 is disposed near the right angle formed by the intersection of sides 150 and 152, actuator tab 142 is linked to the corner of lever 148 which is formed by the intersection of the short side 150 and hypotenuse 154, such as via threaded rods 158 and 160 and an interconnecting turn buckle 162, and a rod or cable 164 links the end of lever 148 formed by the intersection of the longer side 152 and the hypotenuse 154 with the locking pin 146. To complete the car door lock assembly 124, an elongated slot, indicated at 166, is formed in the bottom of the gib groove 21 defined by car door sill 20.

In the operation of car door lock 124, when panel 26 of car door 24 reaches the fully closed position shown in FIG. 1 the open vane 126 will be in a position in which it is no longer in contact with hatch door drive roller. The open vane 126 is thus allowed to swing downwardly and to the right when viewed in FIGS. 1 and 2, by gravity, and also by the spring loaded bias applied to locking pin 146. The dimensional relationships are selected such that the required running clearance of about 0.25 inch will be provided between the open vane 126 and hatch door roller 66. Locking pin 146 is spring biased to enter the slot 166 in the bottom of the gib groove 21 in car door sill 20, preventing car door panel 26, as well as car door panel 28 which is mechanically related to the position of car door panel 26, from being moved more than the length of slot 166.

When the elevator car 10 stops at a floor and door operator 62 starts to move car door panel 26 towards an open position, open vane 126 will contact hatch door roller 66 and swing upwardly and to the left, pivoting lever 148 counter clockwise to the position shown in FIG. 2, pulling locking pin 146 upwardly, against the downward spring pressure applied to pin 146, to withdraw pin 146 from the locking slot 166. The car door lock assembly 124 remains in the unlocked configuration of FIG. 2 until the car door 24 again reaches a fully closed position, at which time it will be operated to the position shown in FIG. 1. Attempting to open the car door panels 26 or 28 from within the cab 14 when the car 10 is not close enough to a floor for safe egress, e.g., about 11 inches, for example, will not actuate the car door unlocking mechanism and will allow the car door panels to be moved only the length of slot 166.

Instead of fixing the support arms 82 and 90 of the close vane assembly 70 and the support plate 128 of the open vane assembly 68 directly to the support base 76 via a common pivot axis 165 of door clutch 60, they are pivotally related to support base 76 to provide an embodiment of the invention in which an authorized service or maintenance person may reach between the car and hatch doors 24 and 12, respectively, and easily de-couple the doors for maintenance purposes.

Figure 5:
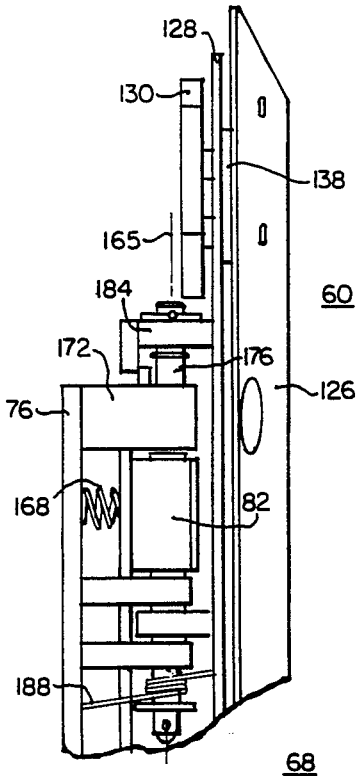
FIG. 5 is a fragmentary left hand elevational view of the car door clutch shown in FIG. 1.
Figure 7:
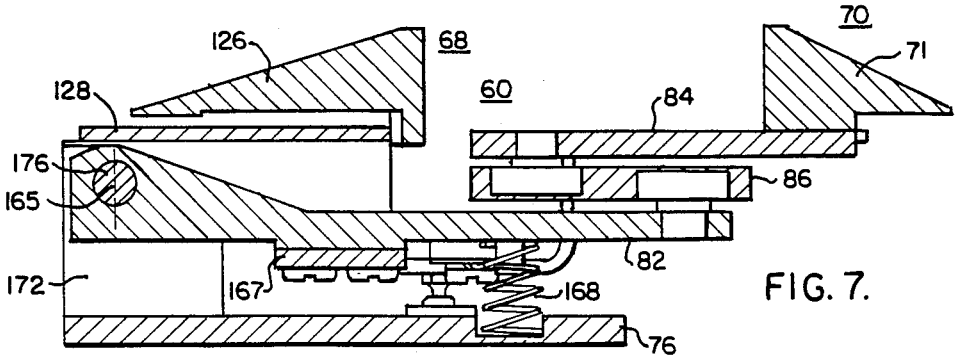
FIG. 7 is a cross sectional view of the car door clutch shown in FIG. 2, taken between and in the direction of arrows VII—VII.

More specifically, as best shown in the exploded perspective view of FIG. 3, a vertically oriented cross bar 167 interconnects support arms 82 and 90 to provide a rigid support frame 169 for the close vane assembly 70, which is pivotally attached to base 76 and biased outwardly to the desired operative position by upper and lower springs 168 and 170. FIGS. 5 and 7 clearly illustrate the operational position of spring 168, with FIG. 5 being a fragmentary side elevational view of door clutch 60, and FIG. 7 being a cross sectional view of door clutch 60, taken between and in the direction of arrows VII—VII. Base 76 includes a plurality of vertically spaced upstanding supports or projections 172 having vertically aligned openings 174 for receiving pivot pins 176 and 178. Pivot pins 176 and 178 also link openings 180 and 182 defined by support arms 82 and 90, respectively.

Figure 8:
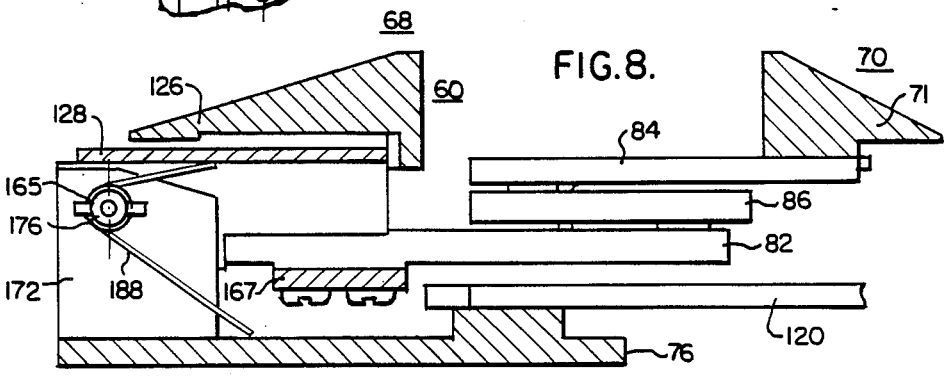
FIG. 8 is a cross sectional view of the car door clutch shown in FIG. 2, taken between and in the direction of arrows VIII—VIII.
Figure 6:
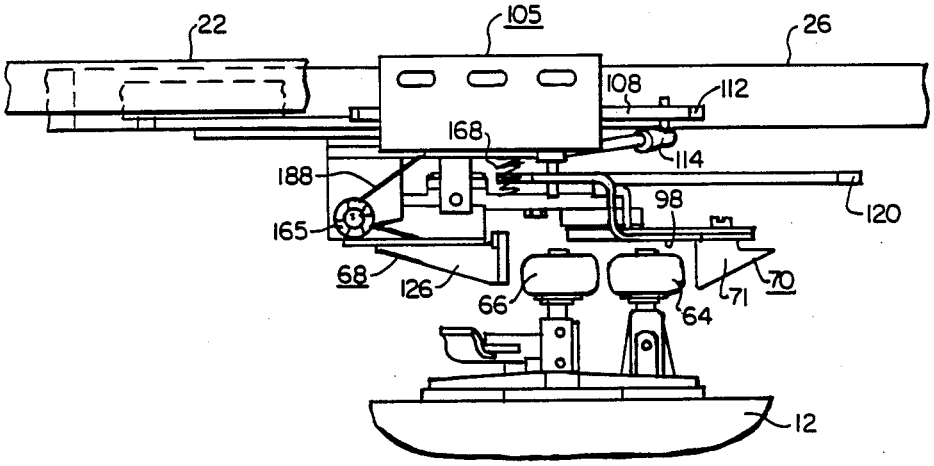
FIG. 6 is a plan view of the car door clutch shown in FIG. 1, with the car door clutch biased to a normal operative position.
Figure 9:
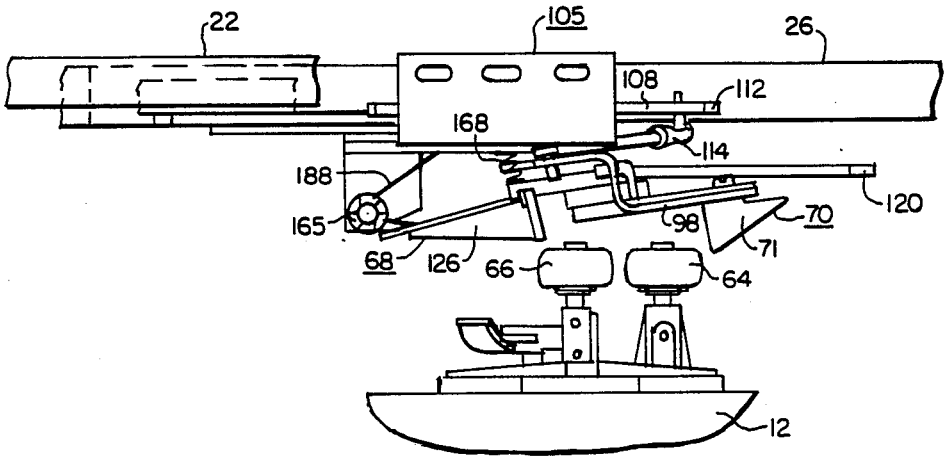
FIG. 9 is a plan view of the car door clutch, similar to FIG. 6, except with the car door clutch being manually actuated to a temporary maintenance position which enables the open and close vanes of the car door clutch to clear the hatch door rollers during relative horizontal movement between them.

In like manner, support plate 128 for the open vane 126 includes a plurality of vertically spaced projections 184 having vertically aligned openings 186, which openings are also linked by pivot pins 176 and 178. Springs 188 and 190 bias the open vane assembly 68 outwardly to the operational position shown in FIG. 6. FIGS. 5 and 8 clearly illustrate the operational position of spring 188, with FIG. 8 being a cross sectional view of door clutch 60, taken between and in the direction of arrows VIII—VIII. Manually depressing the open and close vane assemblies 68 and 70 towards the car door 24, against the bias of springs 168, 170, 188 and 190, as shown in FIG. 9, provides clearance between the open and close vanes 126 and 71 and the hatch door drive rollers 66 and 64 such that the car and hatch doors 24 and 12 may be de-coupled for maintenance purposes.

We claim:

1. An elevator car having a cab which defines an opening, including a header and sill respectively disposed above and below the opening, a roller track fixed to the header, a car door having hanger rollers supported by the roller track, a door operator for imparting horizontal rectilinear motion to the car door, to open and close the opening, and a car door clutch carried by the car door having spaced "open" and "close" vanes for engaging hatch door rollers for simultaneous opening and closing of a hatch door with the car door, the improvement comprising:

first means associated with the card door clutch for selectively changing the spacing between the open and close vanes in response to a predetermined mechanical movement, said first means including a parallelogram linkage assembly disposed to swing the close vane between first and second positions which provide first and second predetermined spacings, respectively, between the open and close vanes, with the second predetermined spacing being less than the first predetermined spacing, and second means directly responsive to the position of the elevator car door for providing said predetermined mechanical movement, said second means including a cam and a cam follower arranged for relative movement in response to movement of the elevator car door, and for engagement when the elevator car door is closing the opening to the cab, with said engagement providing the predetermined mechanical movement which changes the spacing between the open and close vanes.

2. The elevator car of claim 1 wherein engagement of the cam follower and cam lifts the close vane from the second to the first position, and disengagement of the cam follower and cam allows the close vane to return to the second position.

3. The elevator car of claim 2 wherein the parallelogram linkage assembly includes first and second parallel links each having first and second spaced pivot axes, with the pivot axes of each link being disposed such that a force applied to the close vane by a hatch door roller will force the parallelogram linkage towards the second position, preventing accidental operation of the parallelogram linkage assembly during a door closing function.

4. The elevator car of claim 1 wherein the cam and cam follower disengage when the elevator car door starts to open the opening to the cab, with said disengagement of the cam and cam follower providing an additional mechanical movement which changes the spacing between the open and close vanes.

5. The elevator car of claim 4 wherein the movement of the close vane between the first and second positions is in a direction opposite to the car door movement which initiated the change in position.

6. An elevator car having a cab which defines an opening, including a header and sill respectively disposed above and below the opening, a roller track fixed to the header, a car door having hanger rollers supported by the roller track, a door operator for imparting horizontal rectilinear motion to the car door, to open and close the opening, and a car door clutch carried by the car door having spaced "open" and "close" vanes for engaging hatch door rollers for simultaneous opening and closing of a hatch door with the car door, the improvement comprising:

first means associated with the car door clutch for selectively changing the spacing between the open and close vans in response to a predetermined mechanical movement, second means directly responsive to the position of the elevator car door for providing said predetermined mechanical movement, and mounting means pivotally mounting the car door clutch to the elevator car door, with said car door clutch being pivotable between an operative position which engages the hatch door rollers of an adjacent hatch door in response to horizontal movement of the elevator car door, and a maintenance position which prevents engagement of the car door clutch with the hatch door rollers of an adjacent hatch door during horizontal movement of the car door, and including means biasing the car door clutch to the operative position, requiring an externally applied force to overcome the bias and pivot the car door clutch to the maintenance position.

7. The elevator car of claim 6 wherein the car door clutch includes a stationary base fixed to the car door, with the mounting means including a frame pivotally fixed to the stationary base which carries the close vane, and means pivotally mounting the open vane to the stationary base, and wherein the means biasing the car door clutch to the operative position includes first spring means for biasing the frame and associated close vane, and second spring means for biasing the open vane.

8. The elevator car of claim 7 wherein the frame and open vane pivot about a common pivot axis.

9. An elevator car having a cab which defines an opening, including a header and sill respectively disposed above and below the opening, a roller track fixed to the header, a car door having hanger rollers supported by the roller track, a door operator for imparting horizontal rectilinear motion to the car door, to open and close the opening, and a car door clutch carried by the car door having spaced "open" and "close" vanes for engaging hatch door rollers for simultaneous opening and closing of a hatch door with the car door, the improvement comprising:

first means associated with the car door clutch for selectively changing the spacing between the open and close vanes in response to a predetermined mechanical movement, and second means directly responsive to the position of the elevator car door for providing said predetermined mechanical movement, said first means including a first parallelogram linkage assembly which is operated by movement of the elevator car door, and including a second parallelogram linkage assembly associated with the open vane, said second parallelogram linkage assembly being actuatable upon contact with a hatch door roller.

10. The elevator car of claim 9 including an opening in the car door sill, and a car door lock carried by the elevator car door operable by the second parallelogram linkage assembly, with said car door lock including a plunger which cooperates with the opening in the car door sill to lock the elevator car door when the elevator car door is completely closed, releasing only when the car door starts to open and the open vane contacts a hatch door roller to actuate the second parallelogram linkage assembly to the second position, with movement to the second position lifting the plunger from the car door sill opening.

11. The elevator car of claim 10 wherein the car door sill opening is elongated to allow a predetermined small movement of the elevator car door while locked.

12. The elevator car of claim 10 wherein the open vane includes movable and fixed vane portions interconnected by the second parallelogram linkage assembly, and the car door lock includes an operating member pivotally fixed to the car door which translates movement of the movable vane portion of the open vane to vertical movement of the plunger.

13. The elevator car of claim 12 wherein the second parallelogram linkage assembly is arranged such that the weight of the movable vane portion inherently biases the second parallelogram linkage assembly towards the first position, to automatically lock the elevator car door when the elevator car door reaches a fully closed position to provide a clearance between the close vane and a hatch door roller of an adjacent hatch door, which allows the second parallelogram linkage to return to the first position.

* * * * *